US008622527B2

(12) United States Patent
Koseki

(10) Patent No.: US 8,622,527 B2
(45) Date of Patent: Jan. 7, 2014

(54) LIQUID JET HEAD, LIQUID JET APPARATUS, AND METHOD OF MANUFACTURING LIQUID JET HEAD

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 103 days.

(21) Appl. No.: 13/199,949

(22) Filed: Sep. 13, 2011

(65) Prior Publication Data

US 2012/0062658 A1 Mar. 15, 2012

(30) Foreign Application Priority Data

Sep. 14, 2010 (JP) ..... 2010-205695

(51) Int. Cl.
*B41J 2/045* (2006.01)

(52) U.S. Cl.
USPC ..... 347/69; 347/71

(58) Field of Classification Search
USPC ..... 347/20, 54, 68, 69, 71, 72
See application file for complete search history.

(56) References Cited

U.S. PATENT DOCUMENTS

| | | | | |
|---|---|---|---|---|
| 4,825,227 | A * | 4/1989 | Fischbeck et al. | 347/69 |
| 5,016,028 | A | 5/1991 | Temple | 346/140 |
| 5,086,308 | A | 2/1992 | Takahashi et al. | 346/140 |
| 5,433,809 | A * | 7/1995 | Pies et al. | 156/268 |
| 5,548,313 | A | 8/1996 | Lee | 347/68 |
| 6,336,715 | B1 | 1/2002 | Hotomi et al. | 347/68 |
| 7,976,136 | B2 * | 7/2011 | Koseki | 347/71 |
| 8,192,006 | B2 * | 6/2012 | Koseki | 347/92 |
| 2005/0157092 | A1 | 7/2005 | Park | 347/68 |
| 2006/0164476 | A1 | 7/2006 | Watanabe et al. | 347/85 |

FOREIGN PATENT DOCUMENTS

| | | |
|---|---|---|
| AL | 0505059 5 | 2/1993 |
| EP | 0528649 | 2/1993 |
| EP | 1741556 | 1/2007 |
| JP | 2000052556 | 2/2000 |

OTHER PUBLICATIONS

Machine-generated translation of JP 2000-052556, published on Feb. 2000.*

* cited by examiner

*Primary Examiner* — Huan Tran
(74) *Attorney, Agent, or Firm* — Adams & Wilks

(57) ABSTRACT

A liquid jet head includes a base plurality of pressure chambers which include recesses, respectively, arranged in a front surface of a base. A piezoelectric substrate is joined to upper surfaces of side walls of the recesses and is uniformly polarized in a direction parallel to a substrate surface of the piezoelectric substrate. A pair of a front surface drive electrode and a back surface drive electrode are provided on a front surface of the piezoelectric substrate, which is opposite to the pressure chamber side, and on a back surface of the piezoelectric substrate on the pressure chamber side, respectively, for each chamber and sandwich the piezoelectric substrate therebetween and extend to a side wall of the recess substantially from a center of the open end. A liquid chamber is formed in the base and communicates with the pressure chambers via openings formed in bottom surfaces or side wall surfaces of the recesses, respectively.

16 Claims, 8 Drawing Sheets

LIQUID JET HEAD, LIQUID JET APPARATUS, AND METHOD OF MANUFACTURING LIQUID JET HEAD

BACKGROUND OF THE INVENTION

1. Field of the Invention

The present invention relates to a liquid jet head, a liquid jet apparatus, and a method of manufacturing a liquid jet head in which a piezoelectric body polarized in a direction in parallel to a substrate surface is joined to upper surfaces of side walls of a recess that forms a pressure chamber for inducing thickness shear deformation to discharge liquid.

2. Description of the Related Art

In recent years, an ink jet type liquid jet head for discharging ink droplets on recording paper or the like to render a character or a graphics or for discharging a liquid material on a surface of an element substrate to form a pattern of a functional thin film is used. In such a liquid jet head of this type, ink or a liquid material is supplied from a liquid tank via a supply tube to the liquid jet head, the ink is caused to fill minute space formed in the liquid jet head, and the capacity of the minute space is momentarily reduced according to a drive signal to discharge a liquid droplet from a nozzle which communicates to the minute space.

Many types of a liquid jet head of this kind have been proposed. Among them, a liquid jet head which uses a thickness shear mode of a piezoelectric element is driven with efficiency and densification thereof is possible. For example, Japanese Patent No. 2666087 describes an ink jet head which uses a thickness shear mode of a piezoelectric body. A bottom sheet formed of a piezoelectric material which is subjected to polarization treatment in a direction perpendicular to a plate surface in advance is prepared, and a large number of grooves in parallel to one another are formed in a surface of the bottom sheet using a dicing blade. A drive electrode is formed on a side wall of each groove, and an upper opening of each groove is closed with an insulating upper sheet. When voltage is applied to the electrode and an electric field is applied in a direction orthogonal to the direction of the polarization, shear mode distortion is created in the side wall forming the groove, and the capacity of minute space formed by the groove changes. The change in the capacity causes liquid which fills the groove to be discharged from a nozzle which communicates to the groove.

Japanese Patent Translation Publication No. Hei 02-501467 also describes an ink jet head in which the capacity of minute space is changed using thickness shear deformation of a piezoelectric body. A plate for a pressure chamber is stacked on a plate for adding stiffness to form a pressure chamber which includes a recess. A transducer formed of a piezoelectric plate is placed on an upper end opening of the pressure chamber. The piezoelectric plate is subjected to polarization treatment in a direction in parallel to a plate surface, and the direction of the polarization is reversed at the center of the pressure chamber. Electrodes are formed on a pressure chamber side and on the opposite side (on an outside surface) thereof of the piezoelectric plate. By applying voltage to the electrodes, an electric field is applied in a thickness direction of the piezoelectric plate. By applying the electric field in the thickness direction of the piezoelectric plate, thickness shear stress the direction of which is reversed at the center of the pressure chamber is produced in the piezoelectric plate, and shearing motion is imposed in the piezoelectric plate to be deformed to the recess side or to the opposite side thereof. The shear motion causes ink which fills the pressure chamber to be discharged from an orifice which communicates to the pressure chamber.

Japanese Patent No. 2867437 also describes an ink jet printer head in which the capacity of minute space is changed using thickness shear deformation of a piezoelectric body. A ceramic thin plate is placed on an upper end opening of a recess formed in a channel body to form a channel. The ceramic thin plate has a structure in which piezoelectric ceramic layers polarized in a direction perpendicular to a plate surface and inner electrode layers are stacked in a lateral direction (in a direction of the plate surface). The ceramic thin plate is bonded to upper end portions of side walls of the recess so that the inner electrode layers are situated over both side walls of the recess and at the center of an upper end of the recess. Therefore, the piezoelectric ceramic layers polarized in the direction perpendicular to the plate surface are sandwiched between the inner electrode layer situated at the center of the upper end of the recess and the inner electrode layers situated over the both side walls of the recess, respectively. Voltage is applied to the inner electrode layer at the center of the upper end of the recess and to the inner electrode layers over the both side walls to apply an electric field in a direction orthogonal to the direction of the polarization of the piezoelectric ceramic layers. The electric field applied to the piezoelectric ceramic layers situated on both sides of the center of the upper end of the recess is in the direction of the plate surface of the ceramic thin plate and the direction thereof is reversed at the center of the upper end of the recess. This causes shear deformation in the ceramic thin plate to increase or decrease the capacity of the channel formed of the recess, and ink which fills the channel is discharged.

Japanese Patent Application Laid-open No. Hei 05-50595 also describes an ink jet printer head in which the capacity of minute space is changed using thickness shear deformation of a piezoelectric body. A drive plate in which a piezoelectric member is bonded between non-piezoelectric members is placed at an upper end opening of a body plate having a recess formed therein to form a pressure chamber. The drive plate is formed of a thin plate in which both ends of a thin plate formed of a piezoelectric material are bonded to non-piezoelectric materials. The bonded portions are situated at the center of an upper end of the recess and over side walls of the recess. The width of the non-piezoelectric members over the side walls is the same as the thickness of the side walls, and the non-piezoelectric members at the center have a smaller width. The thin plates formed of the piezoelectric materials on both sides of the center at the upper end of the recess are polarized in the same direction or in opposite directions within a plate surface. A pair of drive electrodes are formed on a back surface on the pressure chamber side and on the opposite front surface of the thin plate formed of the piezoelectric material so as to be opposed to each other. By applying voltage to the pair of the electrodes, an electric field is applied in a direction orthogonal to the direction of the polarization, and the piezoelectric materials undergo shear mode deformation. When the directions of the polarization of the piezoelectric materials on the both sides of the center of the upper end opening of the recess are the same, electric fields in opposite directions are applied to the piezoelectric materials on the both sides, respectively. When the directions of the polarization of the piezoelectric materials on the both sides are opposite, electric fields in the same direction are applied to the piezoelectric materials on the both sides. This causes deformation of the drive plate to the pressure chamber side or to the opposite side thereof, and ink which fills the pressure chamber is discharged from an orifice which communicates to the pressure chamber.

In the ink jet head described in Japanese Patent No. 2666087, the grooves are formed in the surface of the piezoelectric substrate using a dicing blade. The shape of the dicing blade restricts the length of the grooves, and the arrangement pitch and the capacity of the grooves have a strong correlation with the thickness of the side walls formed of the piezoelectric material and the like, and thus, the design flexibility is small. In the ink jet head described in Japanese Patent Translation Publication No. Hei 02-501467, the plurality of strip-like electrodes for adding a polarity other than a drive electrode are formed on the front and back surfaces of the piezoelectric plate. By applying an electric field in the lateral direction along the plate surface, polarization is performed so that the direction thereof is reversed at the center of the pressure chamber. Therefore, a region for the electrodes for the polarization is necessary in the piezoelectric plate, which makes it difficult to form a pressure chamber having a narrow width to densify the arrangement of the ink discharge nozzles. In the ink jet head described in Japanese Patent No. 2867437, when the stacked ceramic is formed, the piezoelectric ceramic materials and the thermistor materials are alternately stacked and then integrally sintered. However, for example, when an ink jet head having a hundred nozzles is formed, it is necessary to stack and sinter two hundred piezoelectric ceramic materials and thermistor materials, which is two times the nozzles. It is difficult to precisely control the nozzle pitch, and thus, materialization of such an ink jet head is impossible in reality. In the ink jet printer head described in Japanese Patent Application Laid-open No. Hei 05-50595, similarly to the case of the above-mentioned Japanese Patent No. 2867437, it is necessary to stack an enormous number of the piezoelectric members and the non-piezoelectric members. Further, when the non-piezoelectric member is formed, it is necessary to alternately stack the thick layers and the thin layers. Materialization of such an ink jet printer head is extremely difficult in reality.

SUMMARY OF THE INVENTION

The present invention has been made in view of the above-mentioned circumstances, and an object of the present invention is to provide a liquid jet head which has great design flexibility and which may be manufactured with ease.

A liquid jet head according to the present invention includes: a base having a plurality of pressure chambers which include recesses, respectively, the plurality of pressure chambers being arranged in a front surface of the base in a predetermined direction; a piezoelectric substrate which is joined to upper surfaces of side walls of the recesses and which closes open ends of the recesses; a liquid supply chamber for supplying liquid to the plurality of pressure chambers; and orifices for discharging the liquid from the plurality of pressure chambers, in which: the piezoelectric substrate is uniformly polarized in a direction in parallel to a substrate surface of the piezoelectric substrate; and a pair of drive electrodes on a front surface of the piezoelectric substrate, which is opposite to the pressure chamber side, and on a back surface of the piezoelectric substrate on the pressure chamber side, respectively, sandwich the piezoelectric substrate therebetween and extend to a side wall of corresponding one of the recesses substantially from a center of corresponding one of the open ends.

Further, the piezoelectric substrate which closes the open ends of adjacent recesses is divided at the upper surface of the side wall placed between the recesses adjacent to each other.

Further, the orifices are placed on the side wall side of the recesses.

Further, a bottom surface of each of the recesses in proximity to each of the orifices is inclined so that a depth becomes smaller toward an opening of each of the orifices, and the side walls in proximity to each of the orifices of the recesses form a shape of a funnel which has a width tapered toward the opening of each of the orifices.

Further, the liquid supply chamber communicates to the pressure chambers via openings which are formed in bottom surfaces or side wall surfaces of the recesses, respectively, and the liquid supply chamber is formed in the base along the predetermined direction and communicates to the plurality of pressure chambers.

Further, a liquid supply port for supplying the liquid to the liquid supply chamber is placed in the front surface of the base.

Further, each of the orifices is placed on a bottom portion side of corresponding one of the recesses.

Further, each of the orifices is placed on a bottom portion side and substantially at a center of corresponding one the recesses.

Further, the liquid jet head further includes a liquid discharge chamber for discharging the liquid from the pressure chambers, in which the liquid supply chamber is placed at an end of the recesses which form the plurality of pressure chambers, and the liquid discharge chamber communicates to the plurality of pressure chambers and is placed at an end of the recesses opposite to the liquid supply chamber side with respect to the plurality of pressure chambers.

Further, the liquid discharge chamber communicates to the plurality of pressure chambers via openings which are formed in bottom surfaces or side wall surfaces of the recesses, respectively, and the liquid discharge chamber is formed in the base along the predetermined direction and communicates to the plurality of pressure chambers.

Further, a liquid discharge port for discharging the liquid from the liquid discharge chamber is placed in the front surface of the base.

Further, the base includes a common electrode which is electrically connected to a drive electrode formed on the back surface of the piezoelectric substrate.

Further, the common electrode includes a through hole which is formed in the base along the predetermined direction and a conductive material which fills the through hole.

A liquid jet apparatus according to the present invention includes: the liquid jet head of any of the descriptions above; a moving mechanism for reciprocating the liquid jet head; a liquid supply tube for supplying liquid to the liquid jet head; and a liquid tank for supplying the liquid to the liquid supply tube.

A method of manufacturing a liquid jet head according to the present invention includes: stacking and bonding piezoelectric members polarized in a thickness direction in the thickness direction, to thereby form a piezoelectric block; cutting and dividing the piezoelectric block in such a direction as to set a direction of the polarization parallel to a substrate surface, to thereby obtain a piezoelectric substrate; forming a plurality of elongated strip-like back surface drive electrodes on a back surface of the piezoelectric substrate so as to be in parallel to one another in a direction orthogonal to the direction of the polarization; forming a base having a plurality of pressure chambers which include recesses and which are arranged in a front surface of the base in a predetermined direction; joining the piezoelectric substrate to upper surfaces of the recesses by placing bonded surfaces formed by the stacking and bonding of the piezoelectric substrate over side walls of the recesses; forming a plurality of elongated strip-like front surface drive electrodes on a front surface of the piezoelectric substrate so as to be in parallel to one another in the direction orthogonal to the direction of the polarization and so as to be opposed to the plurality of elongated strip-like back surface drive electrodes with the piezoelectric substrate sandwiched therebetween; and dividing the piezoelectric substrate joined to the upper surfaces of the side walls of the recesses.

Further, the method of manufacturing a liquid jet head further includes grinding the piezoelectric substrate after the joining the piezoelectric substrate.

The liquid jet head according to the present invention includes: a base having a plurality of pressure chambers which include recesses, respectively, the pressure chambers being arranged in a front surface of the base in a predetermined direction; a piezoelectric substrate which is joined to upper surfaces of side walls of the recesses and which closes open ends of the recesses; a liquid supply chamber for supplying liquid to the pressure chambers; and orifices for discharging the liquid from the pressure chambers. The piezoelectric substrate is uniformly polarized in a direction in parallel to a substrate surface of the piezoelectric substrate, and a pair of drive electrodes on a front surface of the piezoelectric substrate, which is opposite to the pressure chamber side, and on a back surface of the piezoelectric substrate on the pressure chamber side, respectively, sandwich the piezoelectric substrate therebetween and extend to a side wall of the recess substantially from a center of the open end. Thickness shear deformation may be caused in the piezoelectric substrate irrespective of the thickness and the length of the side walls forming the recesses, and thus, a liquid jet head in which the design flexibility in the conditions of driving the pressure chambers and in the length and the arrangement pitch of the pressure chambers increases, which has a simple structure, and which is manufactured with ease may be provided.

DETAILED DESCRIPTION OF THE PREFERRED EMBODIMENTS (Liquid Jet Head)

Figure 1A:
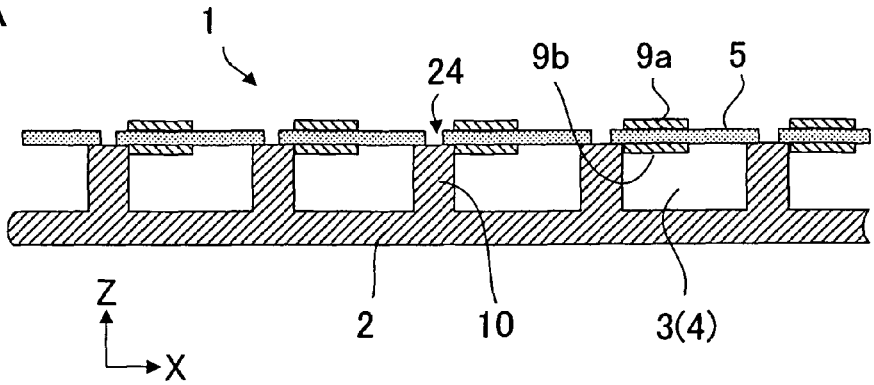
FIGS. 1A to 1C are schematic sectional views illustrating a basic structure of a liquid jet head of the present invention.
Figure 1B:
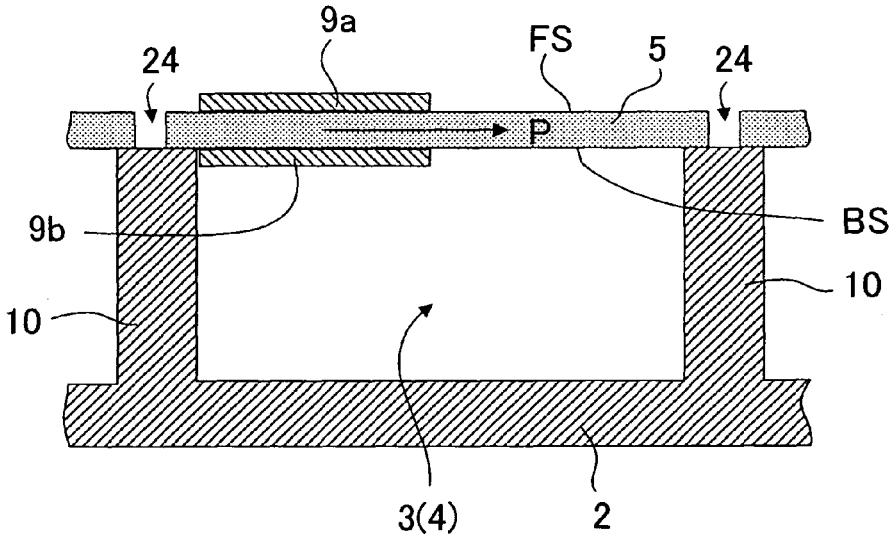
Figure 1C:
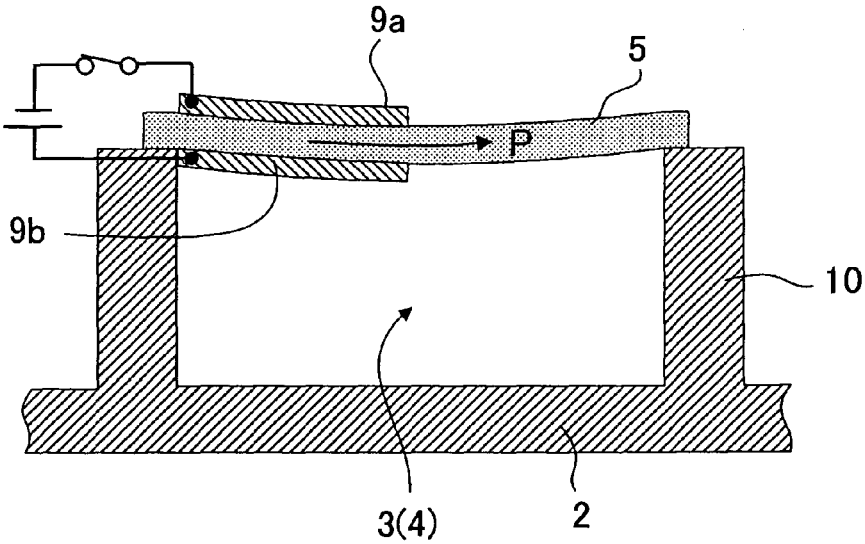

FIGS. 1A to 1C are schematic sectional views illustrating a basic structure of a liquid jet head 1 of the present invention. FIG. 1A is a schematic sectional view illustrating a state in which a plurality of pressure chambers 4 which are recesses 3 are arranged in a predetermined direction, FIG. 1B is a schematic sectional view of one of the pressure chambers 4, and FIG. 1C is a schematic view illustrating a state in which voltage is applied to electrodes to cause thickness shear deformation. The liquid jet head 1 of the present invention includes a base 2 having the plurality of pressure chambers 4 which are the recesses 3 arranged in the predetermined direction which is an X direction in a surface thereof, and a piezoelectric substrate 5 joined to upper surfaces of side walls 10 of the recess 3 to close an open end of the recess 3. The liquid jet head 1 further includes a liquid supply chamber (not shown) for supplying liquid to the pressure chamber 4, and an orifice (not shown) for discharging liquid from the pressure chamber 4.

The piezoelectric substrate 5 is uniformly polarized in a direction in parallel to a substrate surface of the piezoelectric substrate 5 (in a direction P of polarization). A pair of drive electrodes 9*a* and 9*b* are formed on a front surface FS which is opposite to the pressure chamber 4 side and on a back surface BS which is on the pressure chamber 4 side of the piezoelectric substrate 5, respectively, so as to sandwich the piezoelectric substrate 5. The pair of the surface drive electrodes 9*a* and 9*b* extend to the side wall 10 of the recess 3 substantially from the center of the open end of the recess 3. In other words, the pair of the drive electrodes 9*a* and 9*b* sandwich the piezoelectric substrate 5 in substantially half the region of the open end of the recess 3 substantially from the center of the open end. As illustrated in FIG. 1C, voltage is applied to the pair of the drive electrodes 9*a* and 9*b* to apply an electric field in a direction orthogonal to the direction P of polarization. This produces thickness shear stress in the piezoelectric substrate 5 and deforms the piezoelectric substrate 5 toward the inside of the recess 3 (when the polarity is reversed, deforms the piezoelectric substrate 5 toward the outside of the recess 3), and liquid which fills the pressure chamber 4 is caused to be discharged from the orifice (not shown) which communicates to the pressure chamber 4.

As described above, thickness shear deformation may be caused in the piezoelectric substrate 5 irrespective of the thickness and the length of the side walls 10, and thus, the design flexibility in the conditions of driving the pressure chambers and the pitch in the X direction and the length of the pressure chambers increases. Further, the piezoelectric substrate 5 at the open end of the recess 3 is uniformly polarized, and thus, it is not necessary to insert an electrode region or a bonded region for defining different directions of polarization. Accordingly, the structure may be made simple and the conditions of driving the pressure chambers may be uniformized. Further, an electrode for inducing polarization in an in-plane direction of a substrate surface, such as an electrode for adding a polarity, is not necessary, and thus, the pressure chambers 4 may be arranged with high density. Further, as illustrated in FIGS. 1A to 1C, the piezoelectric substrate 5 which is joined to adjacent recesses 3 is divided by a dividing groove 24, and thus, capacitive coupling between the piezoelectric substrates 5 of adjacent pressure chambers 4 is reduced and crosstalk due to leakage of a drive signal may be reduced.

Note that, as described in detail in the following, the piezoelectric substrate 5 may be formed as follows. That is, a piezoelectric block is formed by stacking and bonding piezoelectric materials which are polarized in a direction perpendicular to surfaces of the piezoelectric materials, and then the piezoelectric block is cut and divided in such a direction as to set the direction of the polarization parallel to the substrate surface. In this case, the piezoelectric substrate is joined to upper surfaces of side walls so that a bonded surface on which the piezoelectric substrate is bonded does not fall within a region in which the recess is driven, and thus, the performance of the pressure chambers of discharging a liquid droplet may be uniformized. As the piezoelectric substrate 5, a piezoelectric material such as lead zirconate titanate (PZT) or barium titanate ($BaTiO_3$) may be used. The drive electrodes 9*a* and 9*b* may be formed by patterning a metal material which is deposited by vapor deposition or sputtering. As the base 2, a ceramic material, a glass material, or other materials may be used. In this case, it is preferred that a material having a thermal expansion coefficient similar to that of the piezoelectric substrate 5 be used. Embodiments of the liquid jet head 1 of the present invention are described in detail in the following with reference to the attached drawings.

(First Embodiment)

Figure 2:
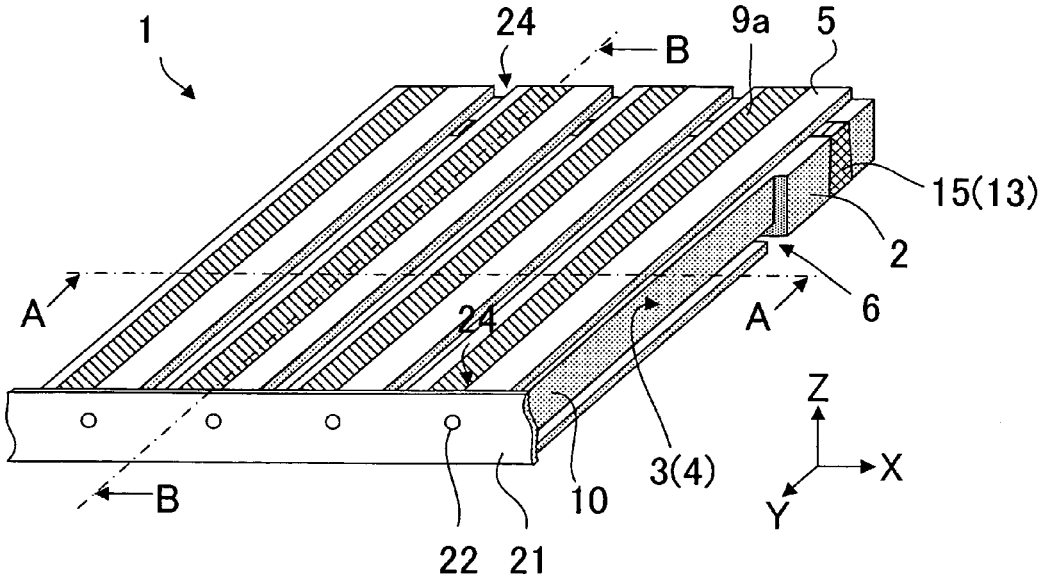
FIG. 2 is a schematic partial perspective view of a liquid jet head according to a first embodiment of the present invention.
Figure 3:
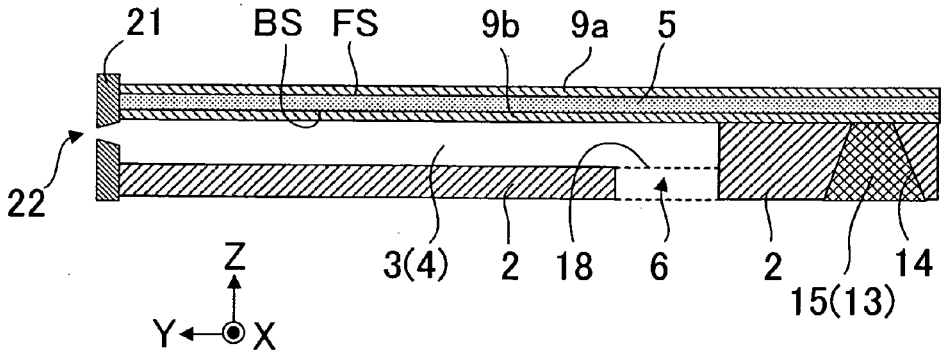
FIG. 3 is a schematic vertical sectional view of the liquid jet head according to the first embodiment of the present invention.

FIG. 2 is a schematic partial perspective view of the liquid jet head 1 according to a first embodiment of the present invention. The schematic vertical sectional view of FIG. 1A which is described above is a vertical sectional view taken along the line A-A of FIG. 2. FIG. 3 is a schematic vertical sectional view taken along the line B-B of FIG. 2. This first embodiment is an edge shoot type liquid jet head 1.

As illustrated in FIGS. 2, 3, 1A, and 1B, the base 2 has the recesses 3 which are elongated in a Y direction and are arranged in the X direction. The piezoelectric substrate 5 is joined to the upper surfaces of the side walls 10 which form the recess 3, and to upper surfaces of the base 2 in a +Z direction (hereinafter referred to as front surfaces of the base 2) at an end in a −Y direction (hereinafter referred to as a rear end of the base 2). The recess 3 and the piezoelectric substrate 5 which closes the open end of the recess 3 form the pressure chamber 4. The piezoelectric substrate 5 is polarized in the X direction which is in parallel to the substrate surface, and is separated from the piezoelectric substrate 5 of an adjacent recess 3 by the dividing groove 24. The piezoelectric substrate 5 has the pair of the drive electrodes 9*a* and 9*b* formed on the front surface FS which is opposite to the pressure chamber 4 side and on the back surface BS which is on the pressure chamber 4 side, respectively, so as to sandwich the piezoelectric substrate 5. The pair of the drive electrodes 9*a* and 9*b* extend to the side wall 10 in a −X direction substantially from the center of the open end of the recess 3. By applying voltage to the pair of the drive electrodes 9*a* and 9*b*, an electric field is applied in a direction orthogonal to the direction P of polarization of the piezoelectric substrate 5 to produce thickness shear stress in the piezoelectric substrate 5. According to the stress, the piezoelectric substrate 5 is deformed to the recess 3 side or to the opposite side.

A nozzle plate 21 is placed at an end in a +Y direction of the recesses 3 which are elongated in the Y direction (hereinafter referred to as a front end of the recesses 3). The nozzle plate 21 has a plurality of orifices 22 formed therein. The orifices 22 communicate to the corresponding recesses 3, respectively. More specifically, the nozzle plate 21 forms a side wall of the recesses 3 at the front end of the recesses 3, and thus, the orifices 22 may be regarded as being formed in the side wall of the recesses 3. The base 2 includes a liquid supply chamber 6. An opening 18 is formed in a bottom surface of the recess 3, which is elongated in the Y direction, at an end in the −Y direction (hereinafter referred to as a rear end of the recess 3), and communicates to the liquid supply chamber 6 formed thereunder. The liquid supply chamber 6 extends under the bottom surfaces at the rear ends of other recesses 3, and communicates to the other recesses 3. Therefore, liquid may be caused to flow from the liquid supply chamber 6 into the respective recesses 3 to fill the respective pressure chambers 4.

The base 2 includes a through hole 14 in the vicinity of the rear end thereof, and a conductive material 15 fills the through hole 14. A side wall of the through hole 14 is tapered so that the diameter of the through hole 14 increases toward a lower surface in a −Z direction of the base 2 (hereinafter referred to as a back surface of the base 2) to facilitate mold formation. The through hole 14 extends in the X direction. The conductive material 15 is electrically connected to the back surface drive electrodes 9*b* formed on the back surfaces BS of other piezoelectric substrates 5 to form a common electrode 13.

Operation of the liquid jet head 1 is as follows. Liquid such as ink is supplied from the liquid supply chamber 6 to the pressure chamber 4 to fill the pressure chamber 4, and a drive signal is applied between the common electrode 13 and the front surface drive electrode 9*a*. Then, the piezoelectric substrate 5 sandwiched between the front surface drive electrode 9*a* and the back surface drive electrode 9*b* undergoes thickness shear deformation. For example, in a "pull back and release" method, the capacity of the pressure chamber 4 is once increased, and then decreased to apply pressure on the liquid to discharge from the orifice 22 a liquid droplet in the +Y direction.

As the piezoelectric substrate 5, a PZT ceramic material is used. As the base 2, an insulating ceramic material is used. The piezoelectric substrate 5 is joined to the upper surfaces of the side walls 10 of the base 2 with an adhesive. As the nozzle plate 21, a thin film formed of polyimide may be used. The dimensions of the liquid jet head 1 are as follows. The length in the Y direction of the recess 3 formed in the base 2 is 5 mm to 8 mm, the width of the recess 3 in the X direction is 0.2 mm to 0.3 mm, and the depth of the recess 3 is about 0.2 mm. The thickness of the side walls 10 of the recess 3 is about 80 μm. The length in the Y direction of the piezoelectric substrate 5 is 5 mm-10 mm, the width of the piezoelectric substrate 5 is 0.25 mm to 0.35 mm, and the thickness of the piezoelectric substrate 5 is 0.01 mm to 0.1 mm. Note that, these materials and dimensions are merely exemplary and the present invention is not limited thereto.

In this embodiment, the pitch of the pressure chambers 4 and the conditions of driving the pressure chambers 4 may be set almost irrespective of the thickness of the side walls 10, and thus, the design flexibility of the liquid jet head 1 is great. Further, the piezoelectric substrate 5 at the open end of the recess 3 is uniformly polarized, and thus, it is not necessary to insert an electrode region or a bonded region for defining different directions of polarization. Accordingly, the structure may be made simple and the conditions of driving the pressure chambers may be uniformized. Further, an electrode for the polarization, such as an electrode for adding a polarity, is not necessary, and thus, the pressure chambers 4 may be arranged with high density. Further, leakage of a drive signal for driving the pressure chamber to the piezoelectric substrate 5 of an adjacent pressure chamber, which causes crosstalk, may be reduced. Further, the back surface drive electrodes 9*b* formed on the back surfaces of the piezoelectric substrates 5 are electrically connected to the conductive material 15 which fills the through hole 14, and are brought together as the common electrode 13. Thus, it is not necessary to form a wiring pattern on a front surface of the base 2.

Note that, instead of forming the through hole 14 in proximity to the rear end of the base 2 and filling the through hole 14 with the conductive material 15 to form the common electrode 13, the following structure may be employed. That is, a common electrode is formed on the front surface in proximity to the rear end of the base 2 and, when the piezoelectric substrate 5 is joined to the front surface of the base 2, the back surface drive electrodes 9*b* formed on the back surfaces of the respective piezoelectric substrates 5 and the common electrode formed on the front surface of the base 2 are electrically connected. This enables collective formation of all the drive electrodes on the front surface of the base 2 and simplified connection to a drive circuit.

(Second Embodiment)

Figure 4A:
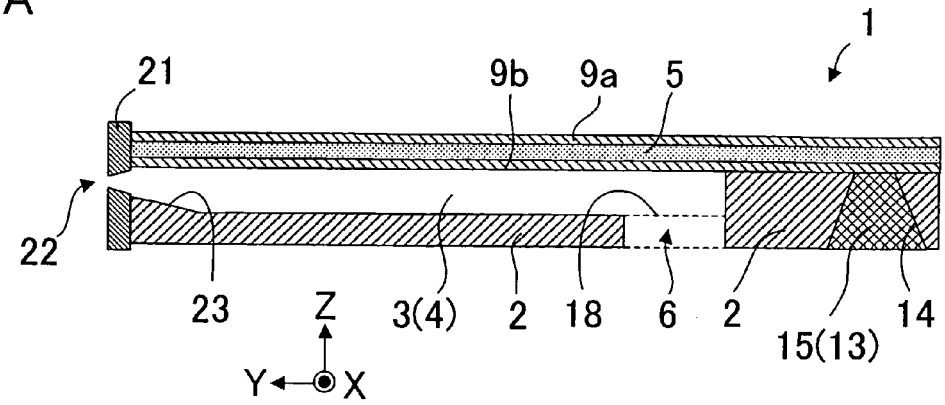
FIGS. 4A and 4B are explanatory diagrams of a liquid jet head according to a second embodiment of the present invention.
Figure 4B:
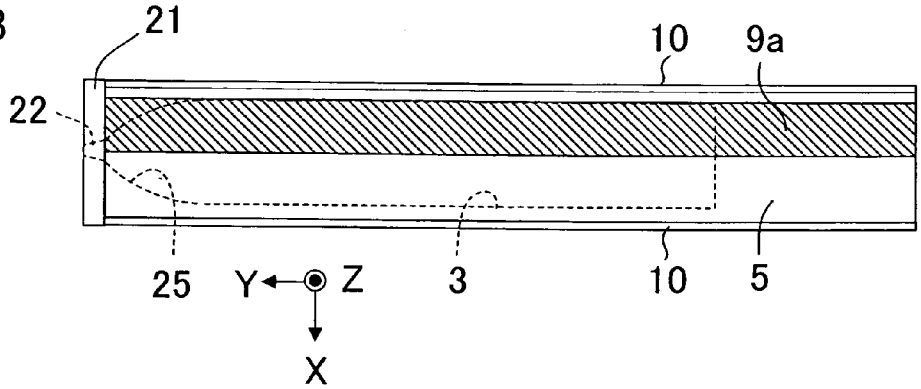

FIGS. 4A and 4B are explanatory diagrams of the liquid jet head 1 according to a second embodiment of the present invention. FIG. 4A is a schematic vertical sectional view and FIG. 4B is a schematic top view. FIGS. 4A and 4B illustrate only one pressure chamber 4. This embodiment is different from the first embodiment in that a front end portion of the pressure chamber 4 is tapered, and is similar to the first embodiment with respect to other points.

As illustrated in FIGS. 4A and 4B, the elongated recess 3 extends from the front end to the rear end of the base 2. The piezoelectric substrate 5 is joined to the upper surfaces of the side walls of the recess 3 with an adhesive so that the open end of the recess 3 is closed. The nozzle plate 21 is bonded to the front end of the base 2. The orifice 22 formed in the nozzle plate 21 communicates to the pressure chamber 4 which includes the recess 3. The opening 18 is formed in the bottom surface at the rear end of the recess 3 and communicates to the liquid supply chamber 6 formed thereunder. The base 2 includes the through hole 14 in proximity to the rear end thereof, and the conductive material 15 fills the through hole 14. The conductive material 15 is electrically connected to the back surface drive electrode 9*b* formed on the back surface of the piezoelectric substrate 5 to form the common electrode 13. Note that, recesses 3 having the same structure are arranged in ±X directions.

As illustrated in FIG. 4A, the bottom surface of the recess 3 is an inclined surface 23 so that the bottom surface becomes higher toward the front end of the recess 3. Further, as illustrated in FIG. 4B, the shape of the recess 3 in a width direction is like a funnel 25 which is tapered toward the front end of the recess 3. This reduces a dwelling region in which liquid which fills the pressure chamber 4 dwells, and reduces accumulation of air bubbles mixed in the liquid and residues in the pressure chamber 4 which results in discharge failure. This embodiment is similar to the first embodiment with respect to other points, and thus, description thereof is omitted.

(Third Embodiment)

Figure 5:
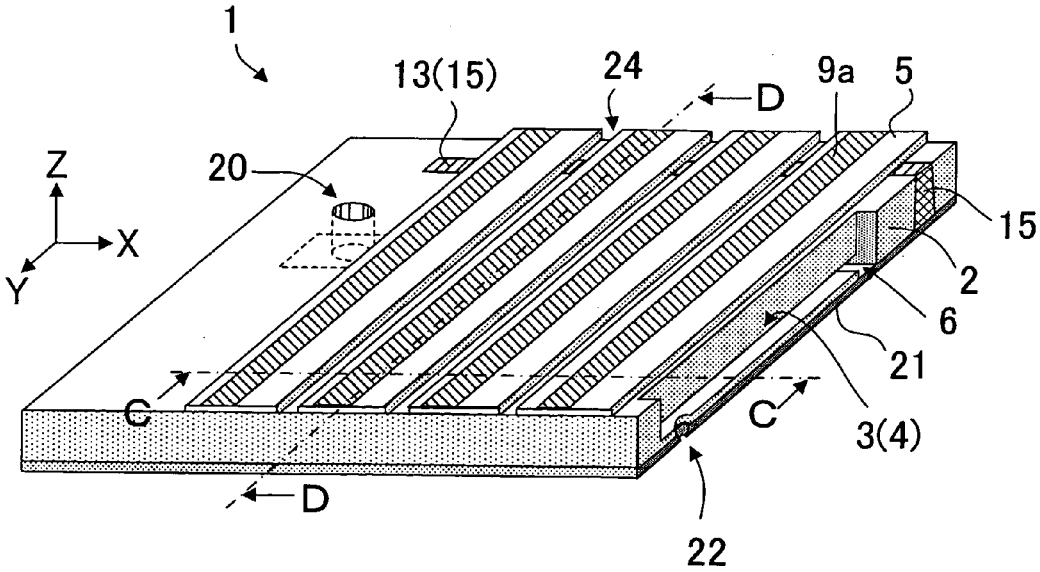
FIG. 5 is a schematic partial perspective view of a liquid jet head according to a third embodiment of the present invention.
Figure 6A:
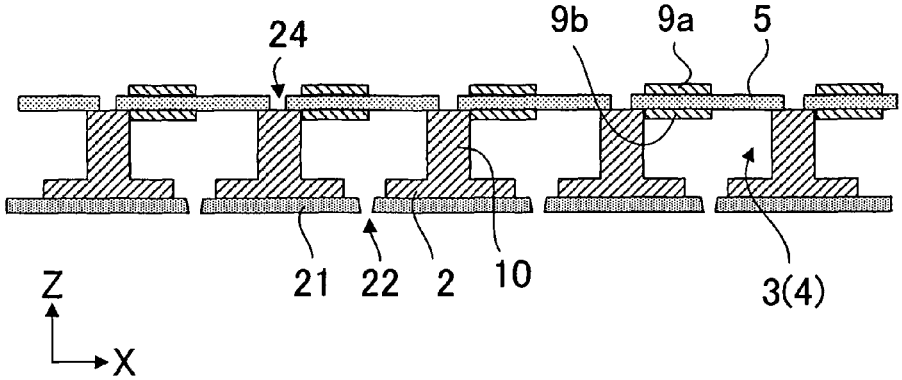
FIGS. 6A to 6C are schematic vertical sectional views of the liquid jet head according to the third embodiment of the present invention.
Figure 6B:
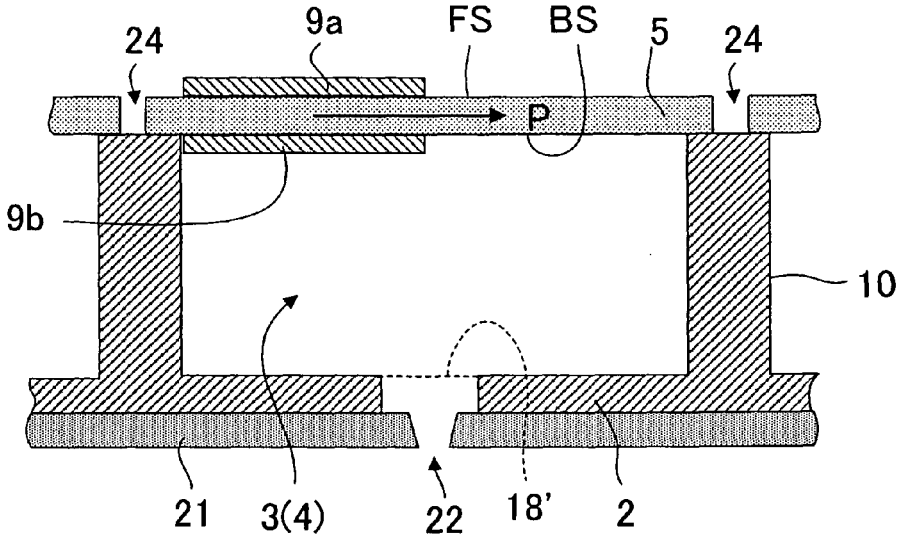
Figure 6C:
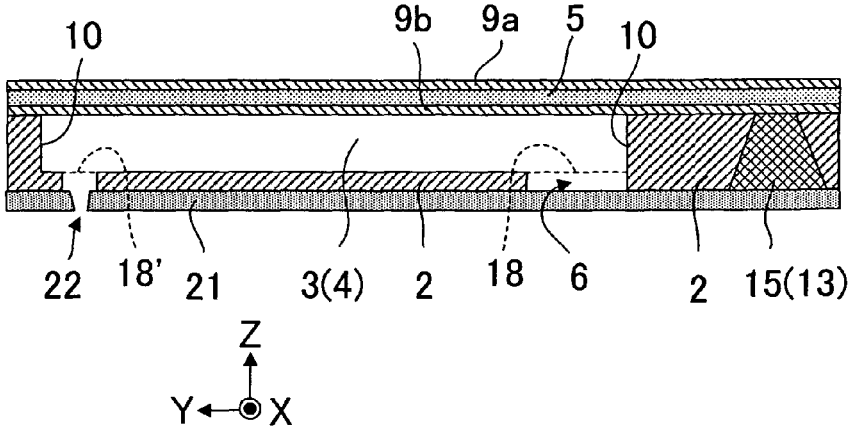

FIG. 5 and FIGS. 6A to 6C are explanatory diagrams of the liquid jet head 1 according to a third embodiment of the present invention. FIG. 5 is a schematic partial perspective view of the liquid jet head 1. FIGS. 6A and 6B are schematic vertical sectional views taken along the line C-C of FIG. 5, and FIG. 6C is a schematic vertical sectional view taken along the line D-D of FIG. 5. This third embodiment is a side shoot type liquid jet head 1. Like reference numerals are used to designate like members or members having like functions.

As illustrated in FIG. 5 and FIGS. 6A to 6C, the base 2 has a plurality of pressure chambers 4 which are arranged in the X direction and which include the recesses 3 that are elongated in the Y direction. Both end portions in the Y direction of the recesses 3 are enclosed with the side walls 10 of the base 2. The piezoelectric substrate 5 is joined to the upper surfaces of the side walls 10 which form each of the recesses 3 and to the front surfaces at the rear end of the base 2. The piezoelectric substrate 5 closes the open end of each of the recesses 3 to form the pressure chamber 4. The piezoelectric substrate 5 which is placed in the upper end opening of each of the recesses 3 is polarized in the X direction which is in parallel to the substrate surface (in the direction P of polarization), and further, is separated from the piezoelectric substrate 5 joined to the upper portions of an adjacent recess 3 by the dividing groove 24. The piezoelectric substrate 5 has the pair of the front surface drive electrode 9*a* and the back surface drive electrode 9*b* on the front surface FS which is opposite to the recess 3 side and on the back surface BS which is on the recess 3 side, respectively, so as to sandwich the piezoelectric substrate 5. The pair of the front surface drive electrode 9*a* and the back surface drive electrode 9*b* extend to the side wall 10 in the −X direction substantially from the center of the open end of the recess 3. By applying voltage to the pair of the front surface drive electrode 9*a* and the back surface drive electrode 9*b*, an electric field is applied in the direction orthogonal to the direction P of polarization of the piezoelectric substrate 5 to produce thickness shear stress in the piezoelectric substrate 5. According to the stress, the piezoelectric substrate 5 is deformed to the recess 3 side or to the opposite side.

The base 2 includes the nozzle plate 21 which is bonded with an adhesive to a back surface thereof that is opposite to the front surface side thereof to which the piezoelectric substrate 5 is joined. The base 2 includes the opening 18 formed in the bottom surface thereof in proximity to the rear end of the recess 3, and another opening 18' formed in the bottom surface thereof in proximity to the front end of the recess 3. The opening 18 communicates to the liquid supply chamber 6 which is formed thereunder and is surrounded by the nozzle plate 21 and the base 2, while the opening 18' communicates to the orifice 22 formed thereunder in the nozzle plate 21. Therefore, the orifice 22 is formed in the nozzle plate 21 at a location in proximity to the front end of the recess 3 and at the center in the width direction (short side direction) of the recess 3. The liquid supply chamber 6 extends under the bottom surfaces in proximity to the rear ends of other recesses 3 and communicates to other pressure chambers 4, and communicates to a liquid supply port 20 which is formed in the front surface in proximity to the end in the −X direction of the base 2. This enables supply of liquid from the front surface side of the base 2.

The base 2 includes the through hole 14 in proximity to the rear end thereof. The conductive material 15 fills the through hole 14 and is electrically connected to the back surface drive electrode 9*b* formed on the back surface BS of the piezoelectric substrate 5 to form the common electrode 13. The side wall of the through hole 14 is tapered so that the diameter of the through hole 14 increases toward the back surface of the base 2. The through hole 14 extends in the X direction. The conductive material 15 is electrically connected to the back surface drive electrodes 9*b* formed on the back surfaces BS of other piezoelectric substrates 5 to form the common electrode 13, which is exposed on the front surface in proximity to the end in the −X direction of the base 2. Therefore, a drive signal may be supplied to the common electrode 13 from the front surface side of the base 2.

Operation of the liquid jet head 1 is as follows. Liquid such as ink is supplied to the liquid supply port 20 provided in the front surface of the base 2, and the pressure chamber 4 is filled via the liquid supply chamber 6. A drive signal is applied between the common electrode 13 and the respective front surface drive electrodes 9*a* formed on the piezoelectric substrates 5. The piezoelectric substrate 5 sandwiched between the front surface drive electrode 9*a* and the back surface drive electrode 9*b* undergoes thickness shear deformation, and the capacity of the pressure chamber 4 is momentarily changed to discharge a liquid droplet from the orifice 22. The liquid droplet is discharged in the −Z direction on the back surface side of the base 2, which is orthogonal to the length direction of the recess 3. Other points including the materials of the piezoelectric substrate 5 and of the base 2 and the shapes of the recess 3 and of the piezoelectric substrate 5 are similar to those in the first embodiment, and thus, description thereof is omitted.

In this structure, thickness shear deformation may be caused in the piezoelectric substrate 5 irrespective of the thickness and the length of the side walls 10, and thus, the design flexibility in setting the conditions of driving the pressure chambers and the pitch in the X direction and the length of the pressure chambers is great. Further, the piezoelectric substrate 5 at the open end of the recess 3 is uniformly polarized, and thus, it is not necessary to insert an electrode region or a bonded region for defining different directions of polarization. Accordingly, the structure may be made simple and the conditions of driving the pressure chambers may be uniformized. Further, an electrode for the polarization, such as an electrode for adding a polarity, is not necessary, and thus, the pressure chambers 4 may be arranged with high density. Further, the piezoelectric substrate 5 which is placed on adjacent pressure chambers 4 is divided by the dividing groove 24, and thus, crosstalk due to leakage of a drive signal to an adjacent pressure chamber side may be reduced. Further, the liquid supply port 20 and the common electrode 13 are disposed in the front surface of the base 2, and thus, the back surface of the base 2 may be planarized and the distance to a recording medium may be made smaller.

(Fourth Embodiment)

Figure 7:
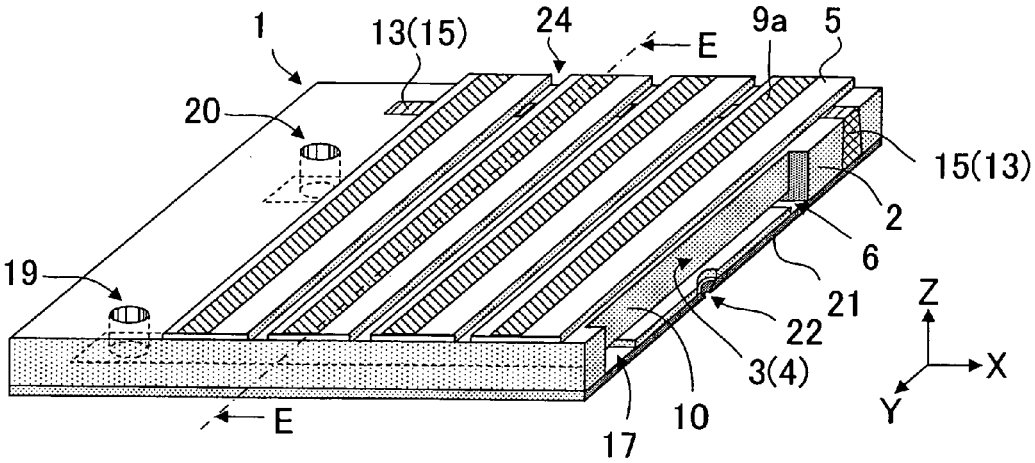
FIG. 7 is a schematic partial perspective view of a liquid jet head according to a fourth embodiment of the present invention.
Figure 8:
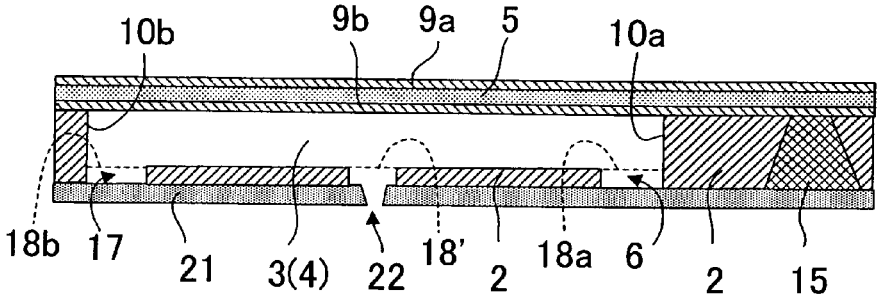
FIG. 8 is a schematic vertical sectional view of the liquid jet head according to the fourth embodiment of the present invention.

FIG. 7 and FIG. 8 are explanatory diagrams of the liquid jet head 1 according to a fourth embodiment of the present invention. FIG. 7 is a schematic partial perspective view of the liquid jet head 1 and FIG. 8 is a schematic vertical sectional view taken along the line E-E of FIG. 7. This embodiment is different from the third embodiment in that the orifice 22 is formed in a lower portion substantially at the center in a long side direction of the pressure chamber 4, an opening 18*b* and a liquid discharge chamber 17 are formed in a bottom portion in proximity to the front end of the recess 3, and the liquid jet head 1 is configured as a through flow type liquid jet head in which liquid which flows from the liquid supply chamber 6 into the pressure chamber 4 is discharged from the liquid discharge chamber 17. This embodiment is substantially similar to the third embodiment with respect to other points. Like reference numerals are used to designate like members or members having like functions.

As illustrated in FIG. 7 and FIG. 8, the base 2 has the plurality of pressure chambers 4 which are arranged in the X direction and which include the recesses 3 that are elongated in the Y direction. Both ends in the Y direction of the recesses 3 are enclosed with the side walls 10*a* and 10*b* of the base 2. The piezoelectric substrate 5 is joined to the upper end openings of the side walls 10 which form each of the recesses 3. The piezoelectric substrate 5 is polarized in the X direction which is in parallel to the substrate surface, and is separated from the piezoelectric substrate 5 placed in an adjacent recess 3 by the dividing groove 24. The piezoelectric substrate 5 has the pair of the front surface drive electrode 9*a* and the back surface drive electrode 9*b* on the front surface FS which is opposite to the recess 3 side and on the back surface BS which is on the recess 3 side, respectively, so as to sandwich the piezoelectric substrate. The pair of the front surface drive electrode 9*a* and the back surface drive electrode 9*b* extend to the side wall 10 in the −X direction substantially from the center of the open end of the recess 3. By applying voltage to the pair of the front surface drive electrode 9*a* and the back surface drive electrode 9*b*, an electric field is applied in the direction orthogonal to the direction P of polarization of the piezoelectric substrate 5 to produce thickness shear stress in the piezoelectric substrate 5. According to the stress, the piezoelectric substrate 5 is deformed to the recess 3 side or to the opposite side.

The base 2 includes the nozzle plate 21 which is bonded to the back surface thereof. The base 2 includes an opening 18*a* formed in the bottom portion at the rear end of the recess 3, the opening 18*b* formed in the bottom portion at the front end of the recess 3, and the opening 18' formed in the bottom portion at the center in the long side direction of the recess 3. The opening 18*a* communicates to the liquid supply chamber 6 which is formed thereunder and which is surrounded by the nozzle plate 21 and the base 2, the opening 18*b* communicates to the liquid discharge chamber 17 which is formed thereunder and which is surrounded by the nozzle plate 21 and the base 2, and the opening 18' communicates to the orifice 22 formed thereunder in the nozzle plate 21. The liquid supply chamber 6 and the liquid discharge chamber 17 extend under the bottom portions at the rear ends and at the front ends, respectively, of other recesses 3 to communicate to other recesses 3, and further, communicate to the liquid supply port 20 and a liquid discharge port 19 which are formed in the front surface in proximity to the end in the −X direction of the base 2, respectively. This causes liquid which is supplied from the front surface side of the base 2 to flow via the liquid supply chamber 6 into the pressure chamber 4 and causes liquid which flows from the pressure chamber 4 into the liquid discharge chamber 17 to be discharged from the liquid discharge port 19. The conductive material 15 fills the through hole 14 formed in proximity to the rear end of the base 2, and then is electrically connected to the back surface drive electrodes 9*b* formed on the back surfaces of the piezoelectric substrates 5, and further, is electrically connected to the common electrode 13 which is exposed on the front surface in proximity to the end in the −X direction of the base 2.

Operation of the liquid jet head 1 is as follows. Liquid which is supplied from the liquid supply port 20 flows via the liquid supply chamber 6 into all the pressure chambers 4. Liquid which flows from the pressure chambers 4 into the liquid discharge chamber 17 is discharged from the liquid discharge port 19. In this way, liquid circulates through all the pressure chambers 4. When a drive signal is applied between the common electrode 13 and the individual front surface drive electrode 9*a* formed on the piezoelectric substrate 5, the piezoelectric substrate 5 sandwiched between the front surface drive electrode 9*a* and the back surface drive electrode 9*b* undergoes thickness shear deformation, and the capacity of the pressure chamber 4 is momentarily changed to discharge a liquid droplet from the orifice 22.

As described above, liquid circulates through the pressure chambers 4, and hence air bubbles are less liable to accumulate and fresh liquid is always supplied. Thus, it is possible to configure the liquid jet head 1 capable of producing a record with high reliability and high quality. In addition, the pitch of the pressure chambers 4 and the conditions of driving the pressure chambers 4 may be set almost irrespective of the thickness of the side walls 10. Thus, the design flexibility of the liquid jet head 1 is great. Further, the piezoelectric substrate 5 at the open end of the recess 3 is uniformly polarized, and thus, it is not necessary to insert an electrode region or a bonded region for defining different directions of polarization, and the structure may be made simple and the conditions of driving the pressure chambers may be uniformized. Further, an electrode for the polarization, such as an electrode for adding a polarity, is not necessary, and thus, the pressure chambers 4 may be arranged with high density. Further, the piezoelectric substrates 5 which are placed on adjacent pressure chambers 4 are divided by the dividing groove 24, and thus, capacitive coupling is reduced and crosstalk due to leakage of a drive signal may be reduced.

(Fifth Embodiment)

Figure 9:
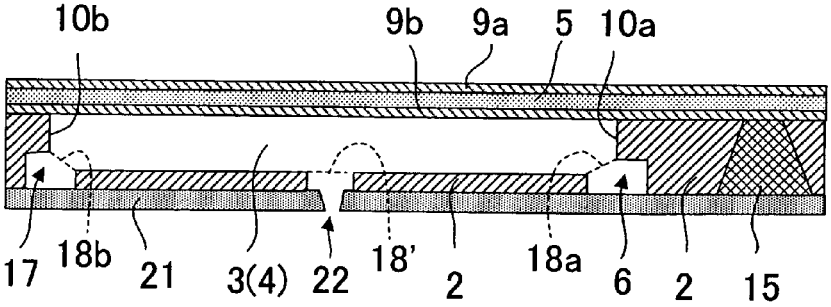
FIG. 9 is a schematic vertical sectional view of a liquid jet head according to a fifth embodiment of the present invention.

FIG. 9 is a schematic vertical sectional view of the liquid jet head 1 according to a fifth embodiment of the present invention. This embodiment is different from the fourth embodiment in that the capacity of the liquid supply chamber 6 and the capacity of the liquid discharge chamber 17 are increased, and is similar to the fourth embodiment with respect to other points. Therefore, in the following, the liquid supply chamber 6 and the liquid discharge chamber 17 are described and description of other points is omitted. Like reference numerals are used to designate like members or members having like functions.

As illustrated in FIG. 9, the liquid supply chamber 6 is situated at the bottom at the rear end of the recess 3 while the liquid discharge chamber 17 is situated at the bottom at the front end of the recess 3. The liquid supply chamber 6 is the sum of a region in which the side wall 10*a* at the rear end of the recess 3 is scooped out toward the back surface and a region in which the bottom surface at the rear end of the recess 3 is pierced to the back surface side, and is enclosed with the nozzle plate 21. Similarly, the liquid discharge chamber 17 is the sum of a region in which the side wall 10*b* at the front end of the recess 3 is scooped out toward the back surface and a region in which the bottom surface at the front end of the recess 3 is pierced to the back surface side, and is enclosed with the nozzle plate 21. The liquid supply chamber 6 communicates to the pressure chamber 4 via the opening 18*a*, the liquid discharge chamber 17 communicates to the pressure chamber 4 via the opening 18*b*, and the orifice 22 communicates to the pressure chamber 4 via the opening 18'.

In this way, a part of the side wall 10*a* and a part of the side wall 10*b* at the rear end and at the front end of the recess 3 are hollowed out utilizing the thickness of the base 2 to form the liquid supply chamber 6 and the liquid discharge chamber 17, respectively. Therefore, the capacity of the liquid supply chamber 6 and the capacity of the liquid discharge chamber 17 are increased, and hence liquid may be caused to flow in/out of all the pressure chambers 4 under substantially the same condition. Therefore, the conditions of discharging from the plurality of orifices 22 may be uniformized.

(Method of Manufacturing Liquid Jet Head)

Figure 10:
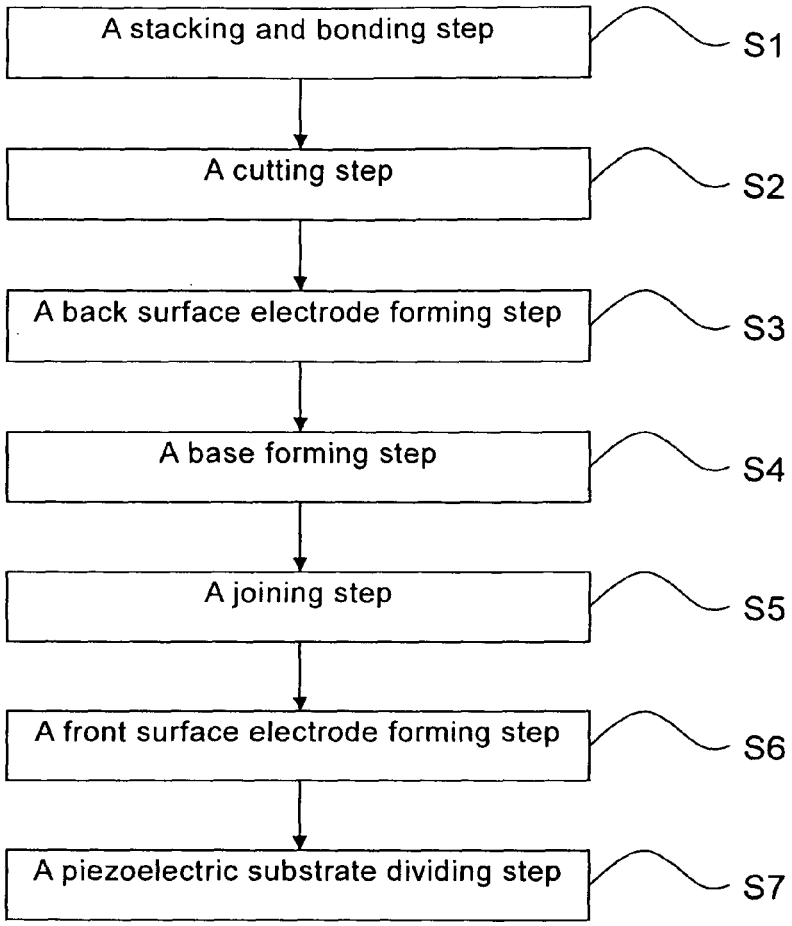
FIG. 10 is a process flow chart illustrating a basic method of manufacturing a liquid jet head of the present invention.

FIG. 10 is a process flow chart illustrating a basic method of manufacturing the liquid jet head 1 of the present invention. The method of manufacturing the liquid jet head 1 of the present invention includes a stacking and bonding step S1 in which piezoelectric members polarized in a thickness direction are stacked and bonded in the thickness direction, that is, in the direction of the polarization, to thereby form a piezoelectric block, a cutting step S2 in which the piezoelectric block is cut and divided in such a direction as to set the direction of the polarization parallel to the substrate surface, to thereby obtain the piezoelectric substrate, a back surface electrode forming step S3 in which the plurality of elongated strip-like back surface drive electrodes are formed on the back surface of the piezoelectric substrate so as to be in parallel to one another in a direction orthogonal to the direction of the polarization, a base forming step S4 in which the base having the plurality of pressure chambers that include the recesses and that are arranged in the front surface thereof in a predetermined direction is formed, a joining step S5 in which the bonded surfaces formed by stacking and bonding in the stacking and bonding step S1 of the piezoelectric substrate are placed over the side walls of the recesses and the piezoelectric substrate is joined to the upper surfaces of the recesses, a front surface electrode forming step S6 in which the plurality of elongated strip-like front surface drive electrodes are formed on the front surface of the piezoelectric substrate so as to be in parallel to one another in the direction orthogonal to the direction of the polarization and so as to be opposed to the back surface drive electrodes with the piezoelectric substrate sandwiched therebetween, and a piezoelectric substrate dividing step S7 in which the piezoelectric substrate joined to the upper surfaces of the side walls of the recesses is divided.

As the piezoelectric member, a ferroelectric ceramic material such as lead zirconate titanate may be used. In the method of manufacturing the liquid jet head of the present invention, one piezoelectric member to be stacked on top of another corresponds to a plurality of recesses, that is, a plurality of pressure chambers, and thus, even when the number of the orifices increases and the pitch of the orifices narrows, the number of the piezoelectric members to be stacked does not increase so much. For example, when the thickness of one piezoelectric member is 15 mm and the pitch of the orifices, that is, the pitch of the recesses to be formed is 0.28 mm, one piezoelectric member corresponds to a little over fifty recesses. More specifically, in order to form 520 orifices with the pitch of 0.28 mm, it is enough that ten piezoelectric members having the thickness of 15 mm are stacked. In this way, the number of the piezoelectric members to be stacked may be remarkably reduced compared with a conventional case.

Note that, the steps S1 to S7 in the above-mentioned manufacturing process are not necessarily required to be performed in this order. The base forming step S4 may be the first step. The front surface electrode forming step S6 may be before the back surface electrode forming step S3, or may be after the piezoelectric substrate dividing step S7. Further, in the base forming step S4, the liquid supply chamber, the liquid discharge chamber, or the through hole for the common electrode may be formed. Further, after the joining step S5, the piezoelectric substrate may be ground to be a thin film, and after that, in the front surface electrode forming step S6, the front surface drive electrodes may formed. This enables easy handling of the piezoelectric substrate. In the following, the manufacturing method of the present invention is specifically described with reference to the attached drawings.

(Sixth Embodiment)

FIGS. 11 to 17 are explanatory diagrams of the method of manufacturing the liquid jet head 1 according to a sixth embodiment of the present invention. Like reference numerals are used to designate like members or members having like functions.

Figure 11:
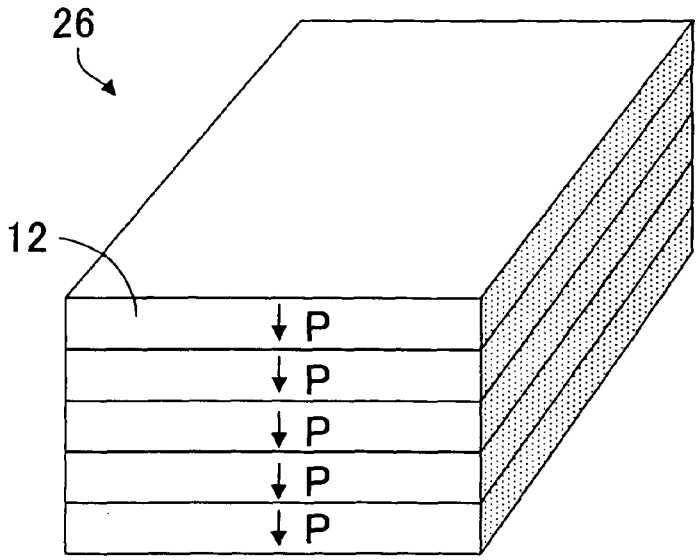
FIG. 11 is a schematic view illustrating a stacking and bonding step in a method of manufacturing a liquid jet head according to a sixth embodiment of the present invention.

FIG. 11 is a schematic view illustrating the stacking and bonding step S1. Five piezoelectric members 12 which are formed of a PZT ceramics and polarized downward in the thickness direction are stacked in the thickness direction and are bonded to form a piezoelectric block 26. The thickness of the piezoelectric member 12 is 15 mm, and the piezoelectric member 12 is polished to have a thickness within an accuracy of ±5 μm. The piezoelectric members 12 are bonded to one another under pressure with an adhesive therebetween.

Figure 12:
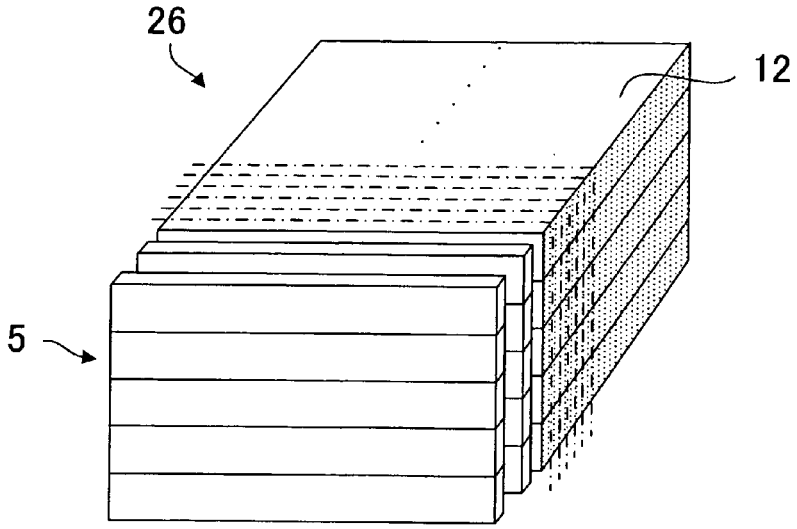
FIG. 12 is a schematic view illustrating a cutting step in the method of manufacturing a liquid jet head according to the sixth embodiment of the present invention.

FIG. 12 is a schematic view illustrating the cutting step S2. In the stacking and bonding step S1, the piezoelectric block 26 formed by stacking and bonding the five piezoelectric members 12 is cut and divided in a direction so that the direction P of polarization is in parallel to the substrate surface. The piezoelectric block 26 is cut and divided with a dicer or a wire saw to obtain the piezoelectric substrate 5. After the piezoelectric substrate 5 is obtained by cutting and dividing, a surface thereof is ground and polished so that the piezoelectric substrate 5 has a thickness of 0.25 mm or more and has a planar surface. The thickness is made to be 0.25 mm or more in order to prevent a crack and chipping of the piezoelectric substrate 5 at subsequent steps when electrodes are formed thereon, patterning is carried out, and joining thereof to the base 2 is carried out and in order to improve the workability.

Figure 13:
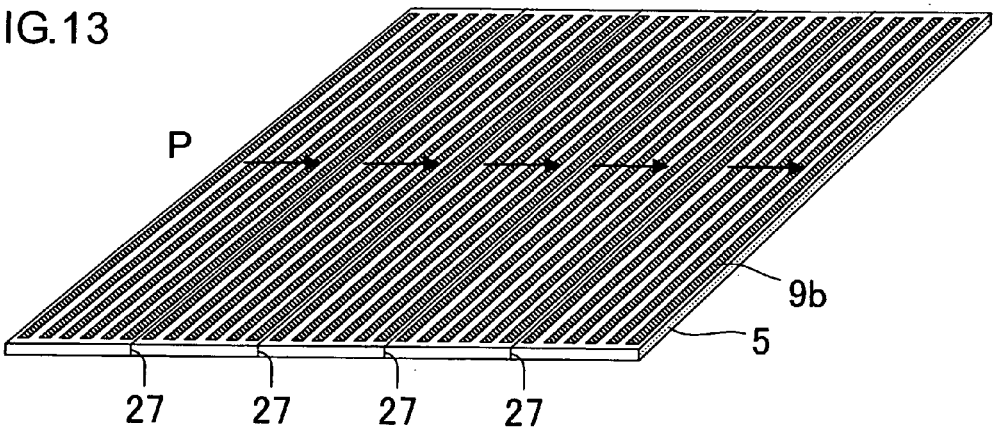
FIG. 13 is a schematic perspective view of a piezoelectric substrate after a back surface electrode forming step in the method of manufacturing a liquid jet head according to the sixth embodiment of the present invention.

FIG. 13 is a schematic perspective view of the piezoelectric substrate 5 after the back surface electrode forming step S3. A metal film is formed on the back surface of the piezoelectric substrate 5 by sputtering or vapor deposition. Then, the plurality of elongated strip-like back surface drive electrodes 9*b* are formed so as to be in parallel to one another in the direction orthogonal to the direction P of polarization by photolithography and etching. One back surface drive electrode 9*b* corresponds to one recess 3 formed in the base 2. In this embodiment, five piezoelectric members 12 are stacked and bonded, and thus, four bonded surfaces 27 are formed in one piezoelectric substrate 5. The thickness of one piezoelectric member 12 is 15 mm, and thus, the length of one piezoelectric substrate 5 is 75 mm. When, for example, the pitch of the orifices is 0.282 mm, about 260 back surface drive electrodes 9*b* are formed on one piezoelectric substrate 5. Note that, the back surface drive electrodes 9*b* may also be formed by a lift-off method in which an electrode pattern is formed in advance using a resist or the like, then a metal film is deposited, and then the resist film is peeled off together with the metal film.

Figure 14:
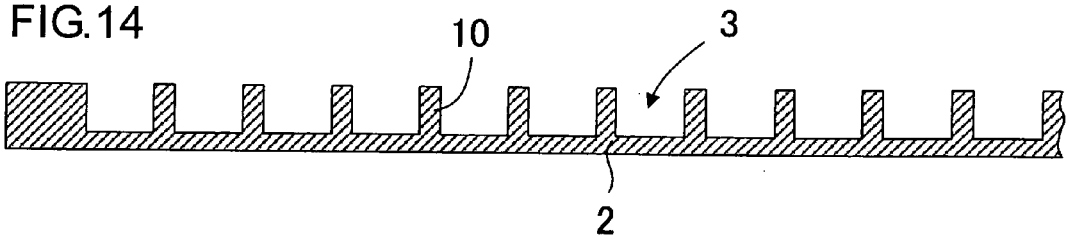
FIG. 14 is a schematic sectional view of a base after a base forming step in the method of manufacturing a liquid jet head according to the sixth embodiment of the present invention.

FIG. 14 is a schematic sectional view of the base 2 after the base forming step S4. As the base 2, a ceramic material is used. A pattern of a resist film is formed on the base 2, and the plurality of recesses 3 are arranged and formed in the front surface of the base 2 along the direction of the polarization by sandblasting or etching. The depth of the recesses 3 is 0.2 mm, the pitch of the recesses 3 is 0.282 mm, and the thickness of the side walls 10 of the recesses 3 is 0.08 mm. Further, the liquid supply chamber and the through hole for the common electrode (not shown) are formed in the bottom portion at the end in the long side direction of the recess 3 and in the side wall at the end in the long side direction of the recess 3.

Figure 15:
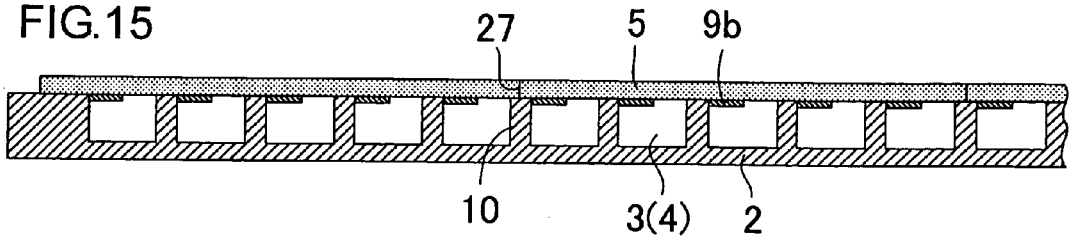
FIG. 15 is a schematic sectional view of the base after a joining step in the method of manufacturing a liquid jet head according to the sixth embodiment of the present invention.

FIG. 15 is a schematic sectional view of the base 2 after the joining step S5. The bonded surfaces 27 of the piezoelectric substrate 5 are placed over the side walls 10 of the recesses 3, and joining is carried out with an adhesive so that the piezoelectric substrate 5 is situated on the upper surfaces of the recesses 3 and so that the back surface drive electrodes 9*b* are situated on the recesses 3 side. Each of the back surface drive electrodes 9*b* extends to the side wall 10 of the recess 3 substantially from the center of the open end of the recess 3. Then, in a grinding step, the front surface of the piezoelectric substrate 5 is polished to make the piezoelectric substrate 5 into a thin film having a thickness of 0.05 mm to 0.1 mm. The bonded surfaces 27 of the piezoelectric substrate 5 are joined to the upper surfaces of the side walls 10, and thus, a bonded surface on which the piezoelectric substrate 5 is bonded does not fall within a region in which the recess 3 is driven, and the performance of the pressure chambers 4 of discharging a liquid droplet may be uniformized.

Figure 16:
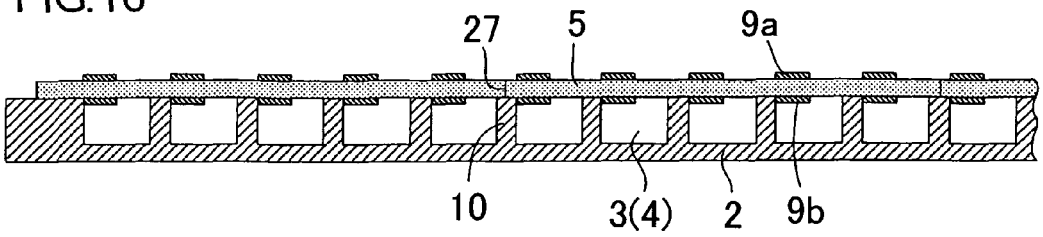
FIG. 16 is a schematic sectional view of the base after a front surface electrode forming step in the method of manufacturing a liquid jet head according to the sixth embodiment of the present invention.

FIG. 16 is a schematic sectional view of the base 2 after the front surface electrode forming step S6. A metal film is deposited on the front surface of the piezoelectric substrate 5 by sputtering or vapor deposition. Then, the metal film is patterned by photolithography and etching to form the front surface drive electrodes 9*a* at locations corresponding to the back surface drive electrodes 9*b* with the piezoelectric substrate 5 sandwiched therebetween. More specifically, the front surface drive electrodes 9*a* are in the shape of a plurality of elongated strips in the direction orthogonal to the direction P of polarization. The front surface drive electrodes 9*a* may also be formed by a lift-off method instead of photolithography and etching.

Figure 17:
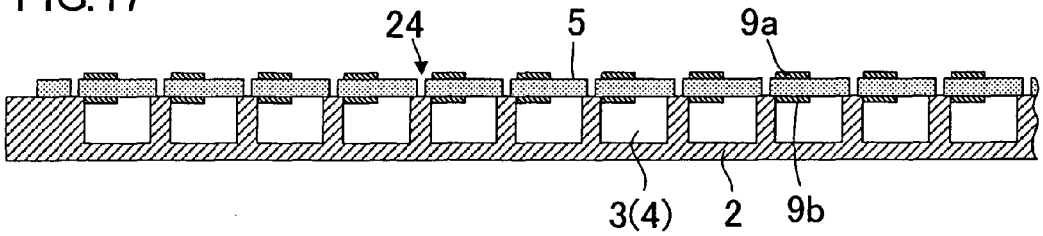
FIG. 17 is a schematic sectional view of the base after a piezoelectric substrate dividing step in the method of manufacturing a liquid jet head according to the sixth embodiment of the present invention.

FIG. 17 is a schematic sectional view of the base 2 after the piezoelectric substrate dividing step S7. The piezoelectric substrate 5 joined to the upper surfaces of the side walls 10 of the recesses 3 is divided using a dicing blade or the like. This reduces crosstalk in which a drive signal for driving the pressure chamber is transmitted by the piezoelectric substrate 5 due to capacitive coupling to affect driving of an adjacent pressure chamber.

As described above, in the method of manufacturing the liquid jet head 1 of the present invention, it is not necessary to stack and bond the piezoelectric members 12 which are as many as or twice as many as the pressure chambers, and thus, even when the liquid jet head 1 has a large number of orifices which are arranged with high density and the number of which is 100 or more, the liquid jet head 1 may be manufactured with ease. Further, the piezoelectric substrate 5 at the open end of the recess 3 is uniformly polarized. Thus, it is not necessary to insert an electrode region or a bonded region for defining different directions of polarization, and the structure may be made simple and the conditions of driving the pressure chambers may be uniformized. Further, an electrode for the polarization, such as an electrode for adding a polarity, is not necessary, and thus, the pressure chambers 4 may be arranged with high density. Further, it is possible to reduce such a phenomenon that a drive signal for driving the pressure chamber leaks to the piezoelectric substrate 5 of an adjacent pressure chamber to cause crosstalk. Further, the arrangement pitch of the pressure chambers 4 and the conditions of driving the pressure chambers 4 may be set irrespective of the thickness of the side walls 10, and thus, the design flexibility increases.

(Liquid Jet Apparatus)

(Seventh Embodiment)

Figure 18:
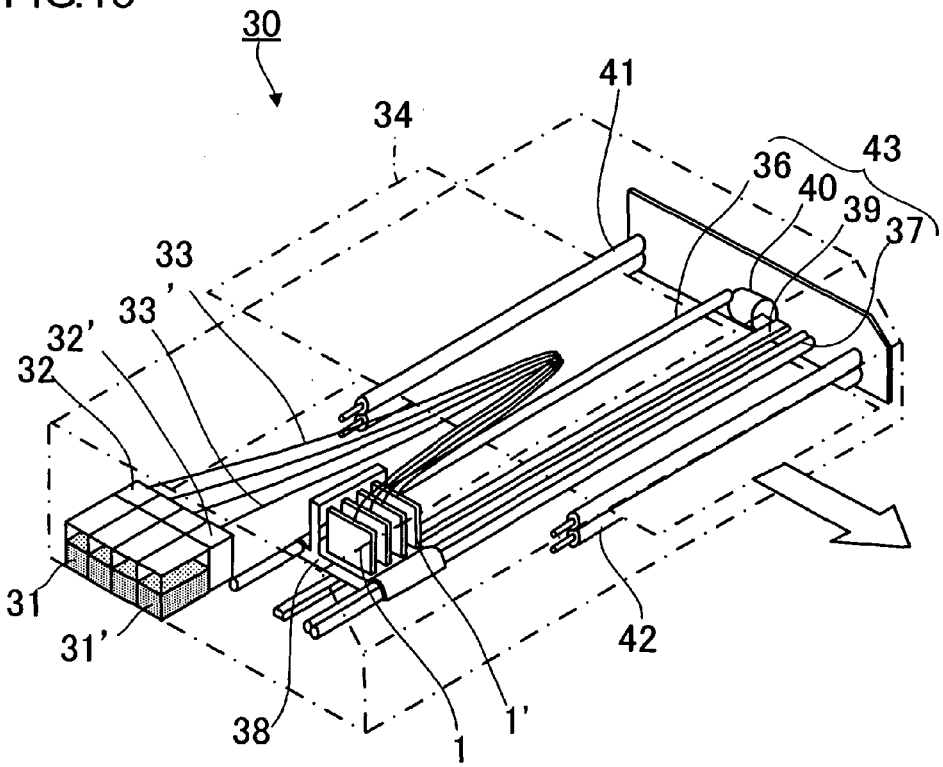
FIG. 18 is a schematic perspective view of a liquid jet apparatus according to a seventh embodiment of the present invention.

FIG. 18 is a schematic perspective view of a liquid jet apparatus 30 according to a seventh embodiment of the present invention.

The liquid jet apparatus 30 includes a moving mechanism 43 for reciprocating a carriage unit 38 having liquid jet heads 1 and 1' mounted thereon, liquid supply tubes 33 and 33' for supplying liquid to the liquid jet heads 1 and 1', and liquid tanks 31 and 31' for supplying liquid to the liquid supply tubes 33 and 33'. The liquid jet heads 1 and 1' are the liquid jet head according to any one of the first to fifth embodiments or the liquid jet head manufactured in the manufacturing method according to the sixth embodiment of the present invention.

Specific description is made in the following. The liquid jet apparatus 30 includes a pair of transfer means 41 and 42 for transferring a recording medium 34 such as paper in a main scan direction, the liquid jet heads 1 and 1' for discharging liquid toward the recording medium 34, pumps 32 and 32' for pressing liquid stored in the liquid tanks 31 and 31' into the liquid supply tubes 33 and 33' for supply, and the moving mechanism 43 for causing the liquid jet head 1 to scan in an auxiliary scan direction which is orthogonal to the main scan direction.

Each of the pair of transfer means 41 and 42 includes a grid roller and a pinch roller which extend in the auxiliary scan direction and which rotate with roller surfaces thereof being in contact with each other. A motor (not shown) axially rotates the grid rollers and the pinch rollers to transfer in the main scan direction the recording medium 34 sandwiched between the rollers. The moving mechanism 43 includes a pair of guide rails 36 and 37 which extend in the auxiliary scan direction, the carriage unit 38 which is slidable along the pair of guide rails 36 and 37, an endless belt 39 coupled to the carriage unit 38, for moving the carriage unit 38 in the auxiliary scan direction, and a motor 40 for rotating the endless belt 39 via a pulley (not shown).

The carriage unit 38 has the plurality of liquid jet heads 1 and 1' mounted thereon, for discharging, for example, four kinds of liquid droplets: yellow; magenta; cyan; and black. The liquid tanks 31 and 31' store liquid of corresponding colors, and supply the liquid via the pumps 32 and 32' and the liquid supply tubes 33 and 33' to the liquid jet heads 1 and 1'. The respective liquid jet heads 1 and 1' discharge liquid droplets of the respective colors according to a drive signal. By controlling discharge timing of liquid from the liquid jet heads 1 and 1', rotation of the motor 40 for driving the carriage unit 38, and transfer speed of the recording medium 34, an arbitrary pattern may be recorded on the recording medium 34.

What is claimed is:

1. A liquid jet head, comprising:

a base having a plurality of pressure chambers which comprise recesses, respectively, the plurality of pressure chambers being arranged in a front surface of the base in a predetermined direction;

a piezoelectric substrate which is joined to upper surfaces of side walls of the recesses and which closes open ends of the recesses, the piezoelectric substrate being uniformly polarized in a direction parallel to a substrate surface of the piezoelectric substrate;

a liquid supply chamber for supplying liquid to the plurality of pressure chambers;

orifices for discharging the liquid from the plurality of pressure chambers; and a pair of drive electrodes provided on a front surface of the piezoelectric substrate, which is opposite to the pressure chamber side, and on a back surface of the piezoelectric substrate on the pressure chamber side, respectively, for each pressure chamber and which sandwich the piezoelectric substrate therebetween and extend to a side wall of a corresponding one of the recesses substantially from a center of a corresponding one of the open ends, wherein the liquid supply chamber communicates to the plurality of pressure chambers via openings which are formed in bottom surfaces or side wall surfaces of the recesses, respectively; and the liquid supply chamber is formed in the base along the predetermined direction and communicates to the plurality of pressure chambers.

2. A liquid jet head according to claim 1, wherein the piezoelectric substrate which closes the open ends of adjacent recesses is divided at the upper surface of the side wall placed between the recesses adjacent to each other.

3. A liquid jet head according to claim 1, wherein the orifices are placed on the side wall side of the recesses.

4. A liquid jet head according to claim 3, wherein a bottom surface of each of the recesses in proximity to each of the orifices is inclined so that a depth becomes smaller toward an opening of each of the orifices, and the side walls in proximity to each of the orifices of the recesses form a shape of a funnel which has a width tapered toward the opening of each of the orifices.

5. A liquid jet head according to claim 1, wherein a liquid supply port for supplying the liquid to the liquid supply chamber is placed in the front surface of the base.

6. A liquid jet head according to claim 1, wherein each of the orifices is placed on a bottom portion side of a corresponding one of the recesses.

7. A liquid jet head according to claim 1, wherein a liquid supply port for supplying the liquid to the liquid supply chamber is placed in the front surface of the base.

8. A liquid jet head according to claim 1, wherein each of the orifices is placed on a bottom portion side and substantially at a center of corresponding one of the recesses.

9. A liquid jet head according to claim 8, further comprising a liquid discharge chamber for discharging the liquid from the plurality of pressure chambers, wherein:

the liquid supply chamber is placed at an end of the recesses which form the plurality of pressure chambers; and the liquid discharge chamber communicates to the plurality of pressure chambers and is placed at an end of the recesses opposite to the liquid supply chamber side with respect to the plurality of pressure chambers.

10. A liquid jet head according to claim 9, wherein:

the liquid discharge chamber communicates to the plurality of pressure chambers via openings which are formed in bottom surfaces or side wall surfaces of the recesses, respectively; and the liquid discharge chamber is formed in the base along the predetermined direction and communicates to the plurality of pressure chambers.

11. A liquid jet head according to claim 8, wherein a liquid discharge port for discharging the liquid from the liquid discharge chamber is placed in the front surface of the base.

12. A liquid jet head according to claim 1, wherein the base comprises a common electrode which is electrically connected to a drive electrode formed on the back surface of the piezoelectric substrate.

13. A liquid jet head according to claim 12, wherein the common electrode comprises a through hole which is formed in the base along the predetermined direction and a conductive material which fills the through hole.

14. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

15. A method of manufacturing a liquid jet head, comprising:

stacking and bonding piezoelectric members polarized in a thickness direction in the thickness direction, to thereby form a piezoelectric block;

cutting and dividing the piezoelectric block in such a direction as to set a direction of the polarization parallel to a substrate surface, to thereby obtain a piezoelectric substrate;

forming a plurality of elongated strip-like back surface drive electrodes on a back surface of the piezoelectric substrate so as to be in parallel to one another in a direction orthogonal to the direction of the polarization;

forming a base having a plurality of pressure chambers which comprise recesses and which are arranged in a front surface of the base in a predetermined direction;

joining the piezoelectric substrate to upper surfaces of the recesses by placing bonded surfaces formed by the stacking and bonding of the piezoelectric substrate over side walls of the recesses;

forming a plurality of elongated strip-like front surface drive electrodes on a front surface of the piezoelectric substrate so as to be in parallel to one another in the direction orthogonal to the direction of the polarization and so as to be opposed to the plurality of elongated strip-like back surface drive electrodes with the piezoelectric substrate sandwiched therebetween; and dividing the piezoelectric substrate joined to the upper surfaces of the side walls of the recesses.

16. A method of manufacturing a liquid jet head according to claim 15, further comprising grinding the piezoelectric substrate after the joining of the piezoelectric substrate.

* * * * *